US005619006A

United States Patent [19]

Maus

[11] Patent Number: 5,619,006

[45] Date of Patent: Apr. 8, 1997

[54] ARTILLERY TUBE RAM DEPTH AND OR BORE CLEAR SENSOR METHOD AND APPARATUS

[75] Inventor: Brian W. Maus, West Lakeland, Minn.

[73] Assignee: FMC Corp., Chicago, Ill.

[21] Appl. No.: 573,793

[22] Filed: Dec. 18, 1995

[51] Int. Cl.[6] ..... F41A 35/00

[52] U.S. Cl. ..... 89/1.1; 42/90; 33/DIG. 21

[58] Field of Search ..... 42/1.01, 90, 106; 89/1.1; 33/506, DIG. 21; 73/167

[56] References Cited

U.S. PATENT DOCUMENTS 4,982,505 1/1991 Pocci ..... 33/542
5,357,840 10/1994 Wanits ..... 89/1.1
5,361,505 11/1994 Faughn ..... 33/506
5,365,332 11/1994 Barber, Jr. et al. ..... 356/241
5,551,182 9/1996 Dahlitz et al. ..... 42/90

*Primary Examiner*—Michael J. Carone
*Assistant Examiner*—Theresa M. Wesson

[57] ABSTRACT

A method and apparatus to automatically sense and check the presence and absence of particulate matter and simultaneously confirm the seating position of a projectile in a predetermined ram depth in a bore of a gun is disclosed. The present invention combines optical and laser diode vision with solid-state controls and mechanical systems with the relevant interface wherein the operation of the apparatus is electronically co-ordinated with the gun fire control system and the breech block operations of the gun.

17 Claims, 3 Drawing Sheets

ARTILLERY TUBE RAM DEPTH AND OR BORE CLEAR SENSOR METHOD AND APPARATUS

TECHNICAL FIELD

The present invention relates generally to a method and apparatus for sensing to make a reliable and an automatic safety check during the firing cycle of a gun system by confirming that the bore of a gun tube is clear of a projectile, combustion remnants and any other obstruction. Modern gun systems are being automated at both the loading and the firing cycles. Accordingly, human interaction at these operations is being replaced by self-contained automatic systems which need a sensor device and method as the one disclosed by the present invention to provide high levels of safety, reliability and serviceability for the gun system.

BACKGROUND OF THE INVENTION

Automated ammunition handling systems under development for use aboard next generation self-propelled artillery pieces and weapon systems require a sensor which can automatically provide several safety checks during the firing preparation cycle. For example, prior to ramming an artillery projectile into the gun tube, a visual or some other check must be made to ensure that the bore of the gun tube is clear of obstructions. These pose explosion dangers and could cause severe damage to the gun if left in the gun tube during firing. Further, the ram depth at which a projectile is set in the gun tube just before firing is a critical parameter to be considered for preventing damage to the projectile, breech and gun tube.

SUMMARY OF THE INVENTION

The present invention anticipates this need and provides a self-cleaning automatic sensor comprising an energy system with laser diodes as the primary source of light and a reflection and absorption sensor incorporated therein to measure the ram depth, and confirm the presence or absence of instruction in the gun tube.

There are a variety of approaches which may be considered to solve the problem. Audio frequency oscillations, ultrasonics, microwaves and light could be used as sensor systems. However, the system advanced and disclosed by the present invention provides a reliable system which is robust and is adapted to the harsh environment of ramming and firing artillery projectiles. Particularly, coherent, monochromatic light focused into many narrow beams are aimed from the breech end of the gun tube towards the open muzzle. These beams include solid-state laser diodes which are the light source, the wavelength of which is determined by the propagation characteristics of the airborne particles anticipated to reside in the gun tube between firings as well as the projectile as it is readied for firing.

Specific advances, features and advantages of the present invention will become apparent upon examination of the following description and drawings dealing with several specific embodiments thereof.

DESCRIPTION OF THE PREFERRED EMBODIMENT

Figure 1:
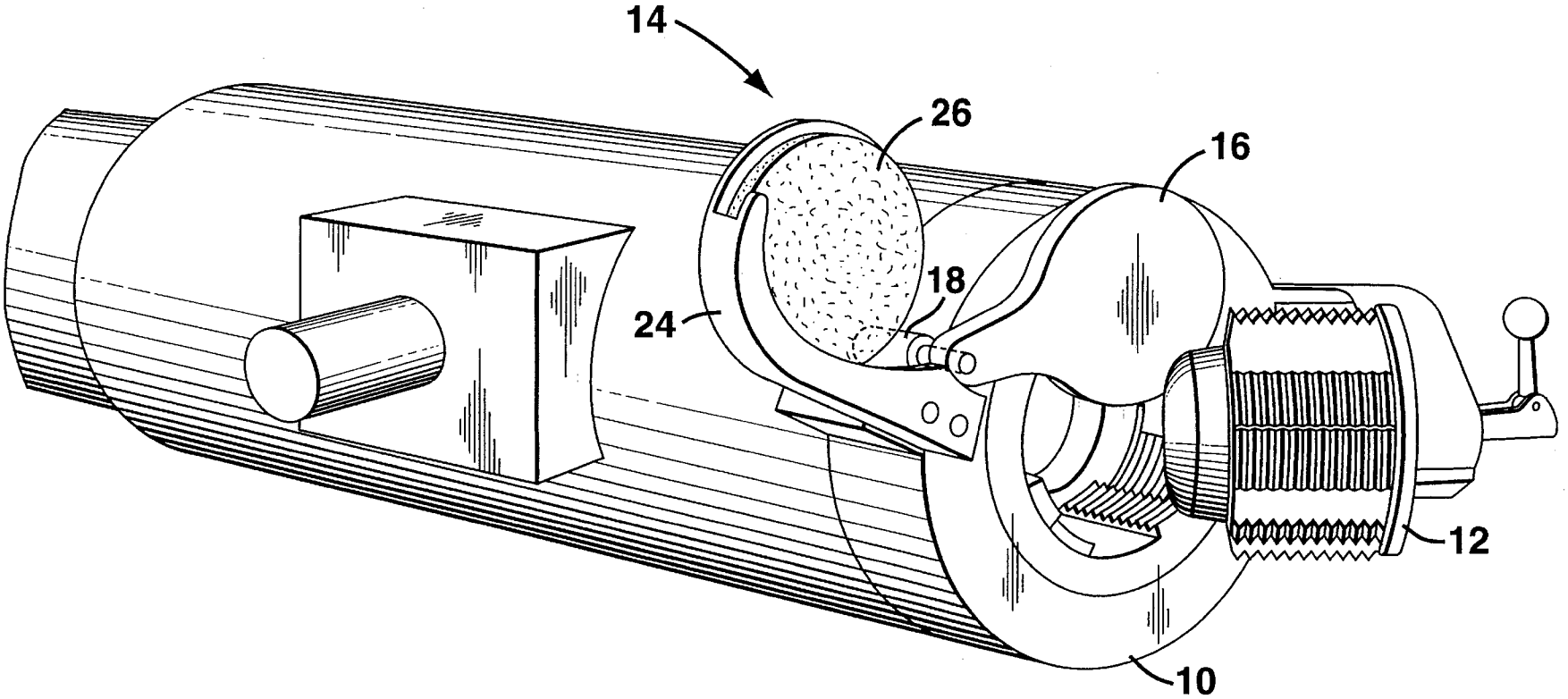
FIG. 1 shows a perspective view of the gun tube, the breech and the ram depth/bore clear sensor assembly.

Referring to FIG. 1 of the drawings, a gun tube 10 to which a breech assembly 12 is attached is shown. Ram depth/bore clear sensor assembly 14 is attached to gun tube 10. Ram depth/bore clear sensor assembly 14 includes transducer assembly 16, rotary actuator 18, stow bracket 24 and cleaner 26 hingeably attached to gun tube 10.

Figure 2:
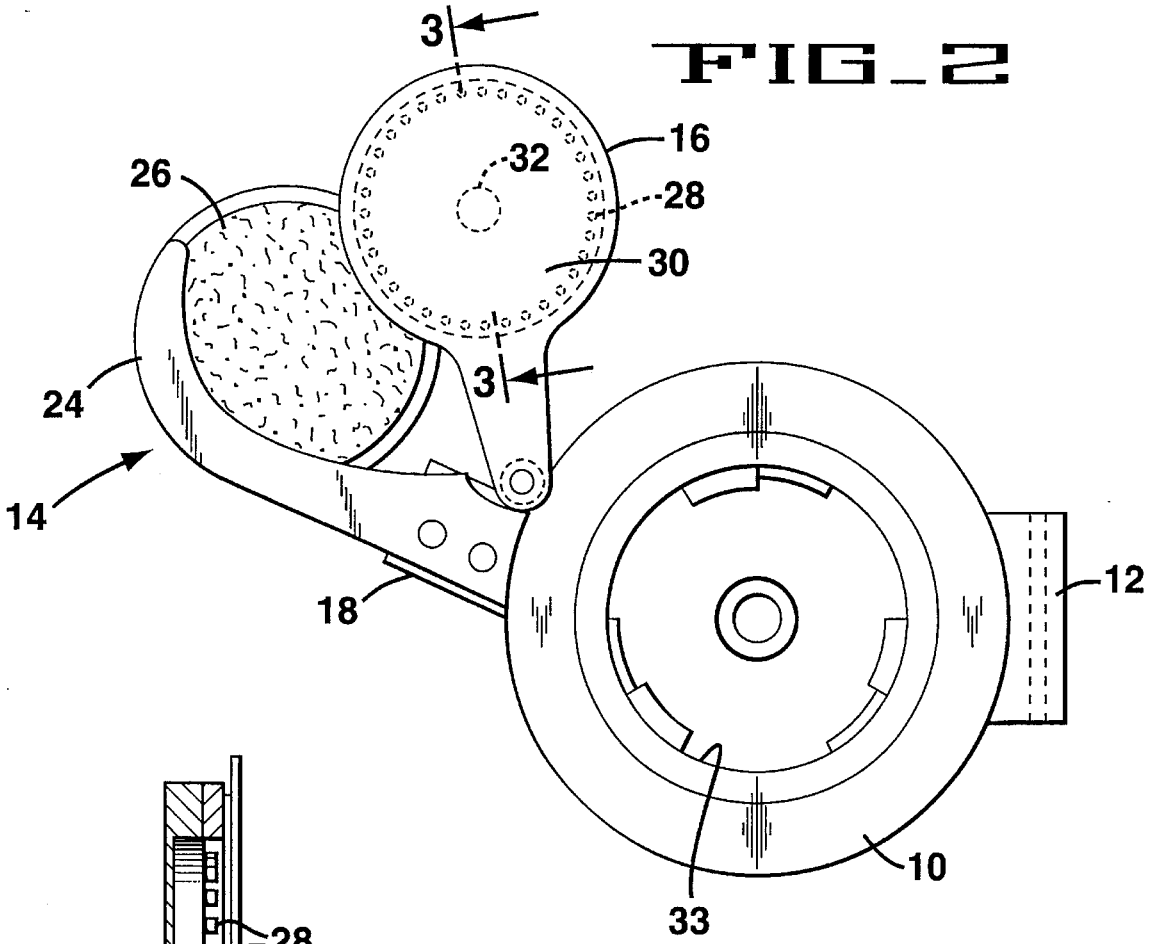
FIG. 2 is an elevation view showing component details of the ram depth/bore clear sensor assembly.
Figure 4:
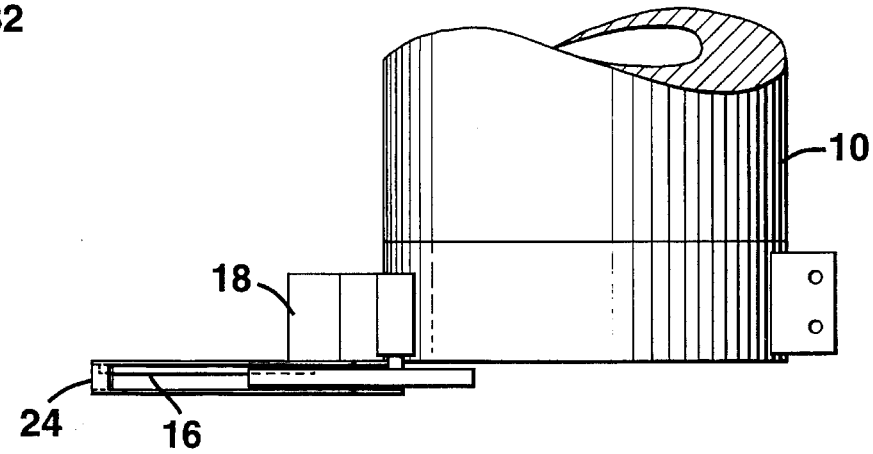
FIG. 4 is a an elevation view showing the ram depth/bore clear sensor in a stowed position.

With reference to FIG. 2, a detail of the ram depth/bore clear assembly 14 is shown. Laser diodes 28 are set substantially around the circumference of transducer assembly 16. Further, diode drivers and multiplex data bus and electronics 30 is embedded in transducer assembly 16. Receiver optics 32 is centrally located in transducer assembly 16. Transducer assembly 16 with the associated hardware and electronics described hereinabove is designed to swingably and precisely fit against the bore opening 33 such that laser diodes 28 face opening 33. As shown in FIG. 4, ram depth/bore clear sensor assembly 14 is stowable and stays clear of ram bore opening 33 and allows breech assembly 12 to engage gun tube 12 as needed.

Figure 5:
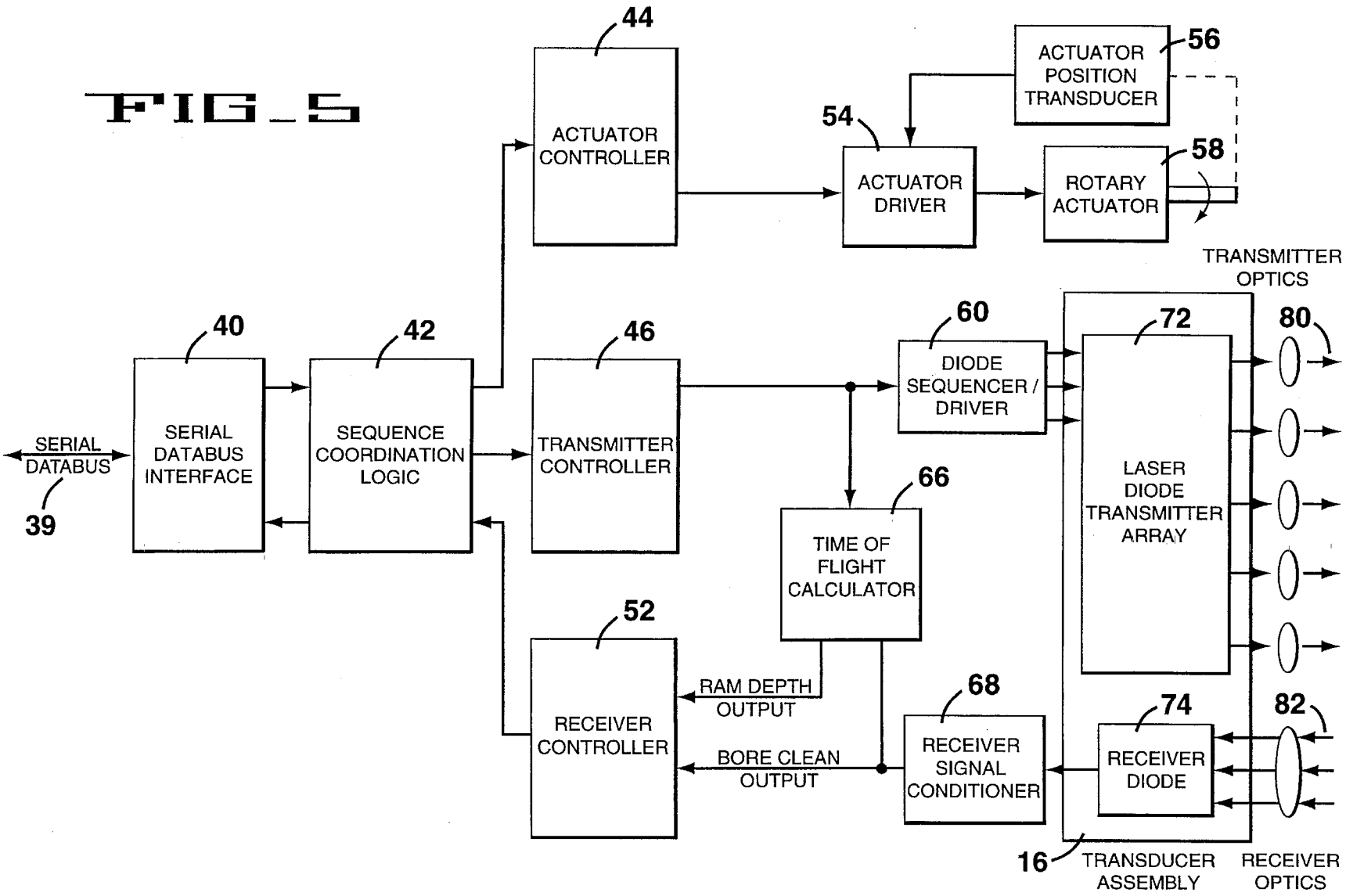
FIG. 5 is a block diagram of the electronic and optics data interface of the ram depth/bore clear sensor.

Referring to FIG. 5, the mechanical, electronic and optics interface of the present invention is represented in sequentially delineated block diagrams. As can be seen, serial data bus 39 introduces data into the fire control system (not shown). Serial data bus interface 40 is a two way gate to forward and receive data to both initiate and terminate the operations of the present invention.

In the preferred embodiment, the present invention operates in lieu of a human operator to enhance the safe operation of an autonomous ramming of an artillery projectile into a gun tube and monitors the bore to check the presence of particles. Further, the depth to which the projectile is seated must be autonomously checked to ensure that the projectile ignition and flight are unencumbered and safe.

Particularly, referring to FIGS. 1–4, a transducer assembly 16 employs a pulsed energy measurement system with laser diodes 28. The transducer assembly 16 includes a disk-like plate rotatable about a pivot point proximate to breech 12. The transducer assembly 16 is moved into position with the breech block 12 open and rotated to the load position. The disk would be precision fitted so that a predetermined degree of alignment would be obtained. This alignment is critical to particle size detection and should have a tight tolerance fit.

The transducer assembly 16 contains a series of laser diodes 28 about the perimeter of the disk. The laser diodes 16 provide a series of parallel light beams which are projected down the bore of gun tube 10. The spacing between the laser diodes 28 is determined by the size of the particulate matter to be detected. The radial spacing of the laser diodes 28 is to be determined by the height of the particulate matter to be sensed. Further, the number of laser diodes 28 is determined by the width of the particulate matter. At the center of the disk embedded receiver 32 is mounted. This is a diode receiver array tuned for the wavelength of the laser energy being transmitted and is fitted with a lens arrangement to provide a field of view equal to the cross section of the gun tube 10.

In its operating mode the present invention incorporates all the elements discussed above and includes: when gun tube 10 is readied for firing, breech block 12 is swingably cleared from opening 33 and rotary actuator 18 rotates transducer assembly 16 to engage opening 33. Normally, transducer assembly 16 is stowed in stow bracket 24. As transducer assembly 16 is rotatably moved into place against opening 33, cleaner/wiper 26 cleans frictionally laser diodes 28. Once in place against opening 33 of gun tube 10, the disc is fixedly held in this position by rotary actuator 18. During a ram depth evaluation wherein the proper seating of a projectile in opening 33 is to be determined, any or all of the laser diode 28 could be fired to determine the distance to the rammed projectile by a time of flight measurement. Further, during a bore clear evaluation, all laser diodes 28 could be fired simultaneously, or sequentially to determine if any debris or obstructions exist in gun tube 10. If any reflection is received by receiver 32, it is a clear indication of an obstruction and the firing cycle is interrupted. Moreover, if the reflection reading is during a bore clear evaluation, the particular firing schedule for the projectile in place is aborted.

As indicated hereinabove, the present invention provides a sensor system to cooperatively operate with a fire control system such that a high level of automation is realized in the firing of a projectile in modern field weapon systems. Particularly, as indicated herein below the components of sensor assembly 14 are designed to be compatible with this objective. Sensor assembly 14 includes transducer 16 which contains laser diodes 28 and receiver 32 and embedded diode drive and MUX electronics 30 forming the assembly as shown in FIGS. 1–4. Sensor assembly 14 can be moved from a stowed position with its face perpendicular to the bore of gun tube 10. The disc is moved into place across opening 33 and into alignment with the circular ring which defines the breech end of gun tube 10. Laser diodes 28 are mounted flush with the surface of transducer 16. In an alternate embodiment, laser diodes 28 may be recessed against the surface of transducer 16. Receiver 32 is also recessed into the face of the disk and limits the thickness of the disk by the focal length required to receive reflections. Embedded diode drive 30 is also located within the disk to connect to laser diodes 28.

Figure 3:
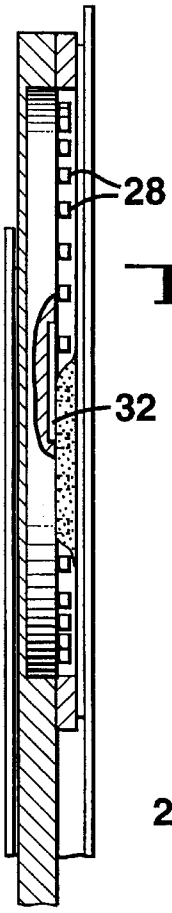
FIG. 3 is a sectional view of FIG. 2 at section 3—3.

Referring now to FIGS. 2 and 3, rotary actuator 18 controls the rotary motion of transducer assembly 16. Generally, the control motion includes moving the transducer assembly 16 from its stowed position into sensing position in line with the bore as required. A precision electric actuator is preferred and could be sized to provide the necessary quick motion so as to meet the time constraints of the firing cycle. For example, a high speed low torque motor may be used to minimize the diameter of rotary actuator 18. An actuator rotary position transducer is utilized to provide the necessary feedback to precisely position the transducer assembly 16 in the exact position against opening 33. As indicated hereinabove, precision of alignment will yield detection capability for smaller particles in the bore.

As indicated hereinabove, during periods of inoperability the transducer assembly 16 is stowed in stow bracket 24. The structure is designed to support wiper/shock absorber 26 as well as transducer assembly 16 in a cantilevered position. Both the wiper/shock absorber 26 and transducer assembly 16 are supported at about one half of the perimeter and are stowably secured in stow bracket 24. One of the unique elements of the present invention includes wiper/shock absorber 26 which is used to clean the laser diodes 28 to avoid blinding due to accumulation of dirt and combustive substances from the firing of a projectile. Further, wiper/shock absorber 26 is used as a shock absorber and a cushion to prevent damage or destruction of the laser diodes 28 during recoil. Furthermore, the connection of ram depth/bore clear assembly 14 and rotary actuator 18 is resilient and anticipates recoil shock as gun tube 10 is being fired.

Referring now to FIG. 5, an electronic package separate from the transducer assembly 16 and rotary actuator 18 is shown. The control electronics provides command and operation to move transducer assembly 16 in and out of the sensing position and for performing the measurement or sensing operations. The electronics system communicates with projectile loader controller for both receiving orders and transmitting the results of the measurements. Interface with transducer assembly 16 and rotary actuator 18 is performed by serial data bus interface 40. Serial data bus (e.g. RS-232, RS-422, etc) provide a communication link between the sensor assembly 14 and the fire control system to which it provides ram depth and bore clear data. Sequence coordination logic 42 is a logical circuitry which controls and sequences the sensor through its primary states, modes and functions. All transmitter, receiver, and actuator states and modes are coordinated by this circuitry. Sequence coordination logic 42 interacts on a two way data exchange with serial data bus 40 such that data is both received and transmitted between them. Sequence coordination logic 42 transmits operations data and command to actuator controller 44. Actuator controller 44 controls the positioning of the transducer assembly 16 over the face of the tube bore in the measurement position, and in the stow bracket in the stowed position. A position control servo loop is contained and closed within this circuitry to perform the function. Thereafter, the data is directed to actuator driver 54 which initiates rotary actuator controls 58. Actuator driver 54 includes servo control and power electronics assembly which closes the position feedback loop around the rotary actuator 18 and drives the transducer assembly 16 with respect to the tube bore and stow bracket 24. This sensor is used to close the position servo control loop around the rotary actuator 18. Rotary actuator controls 58 includes electro-mechanical mechanism which provides the motive power to move the transducer assembly 16 into place before the tube bore. Special gearing may be required to achieve the proper speed/torque profile for the actuator. Actuator position transducer 56 checks the rotary actuator controls 58 and feeds back this information to actuator driver 54 thus forming a closed loop control. Further, sequence coordination logic 42 directs data to transmitter controller 46 which in turn transports data to diode sequencer/driver 60. Transmitter controller 46 includes logic circuitry which controls the laser diode transmitter array 72 timing and sequencing. Diode excitation frequency and duty cycle are controlled by this circuitry. Diode sequencer/driver 60 includes sequential laser diode driver circuitry which fires the diodes in the required order to project monochromatic light about the inner perimeter of the gun tube. The proper timing between successive diodes is provided by this circuitry. Moreover, data from time of flight calculator 66 is input into diode sequencer/driver 60. Time of flight calculator 66 comprises circuitry which calculates the time of flight of the laser light in order to determine the distance from the transducer array to any obstructions in the bore and back to the receiver diode. Diode sequencer/driver 60 feeds data into laser diode transmitter array 72 which in turn transmits the data to transmitter optics 80. Laser diode transmitter array 72 includes an array of laser diodes installed about the perimeter on transducer assembly 16. Each diode is fitted with a dedicated focusing lens to provide the proper beam diameter which is projected down the bore. Receiver optics 82 receives data and transmits the information to receiver signal conditioner 68. Receiver signal conditioner 68 includes circuitry which receives the output of the receiver diode and translates its raw signal level to one which is compatible with the receiver controller electronics, as well as provide any filtering of the signal which may be required to minimize the occurrence of false indications or false readings. It should be noted that the electronics for transmitter optics 80, laser diode transmitter array 72, receiver optics 82 and receiver diode 74 are located within the transducer assembly 16. Further, receiver diode 74 operates as a laser diode which senses the reflected light from any obstruction or particulate matter found in the gun tube of sufficient size to return a reflection. The diode requires a dedicated lens to match the field of view of the tube bore being detected. Wavelength sensitivity of the diode will match that of the transmitter diode, and is selected based on the propagation characteristics of the environment within the tube bore following firing. The receiver signal conditioner 68 transmits bore clear output to receiver controller 52. Receiver controller 52 is a circuit which provides both ram depth and bore clear outputs to the sequence coordination logic 42 for processing to determine at which rotary position an obstruction was sensed, and at what depth. Also, time of flight calculator 66 provides output relating to ram depth and transmits the information to receiver controller 52. The receiver controller 52 inputs information relating to the gun bore and ram depth to sequence coordination logic 42 thus closing the loop.

Accordingly, the present invention provides method and apparatus for ram depth measurement and bore clear sensing using mechanical, electrical, optics, laser, software and solid-state hardware systems integrated and cooperatively interfacing with each other to enable and compose the present invention.

Although the present invention is described above in its preferred form, it shall be understood that various modifications and changes may be made thereto without departing from its spirit and scope of the claims appended hereto.

What is claimed is:

1. An automatic ram depth and bore clear sensing device in a gun system in which a sequence of firing is to be automatically operated, the device comprising:

a sensing system to engage a gun tube and detect one of the presence and absence of particulate matter in the gun tube;

means for moving in and out of position said sensing system relative to said gun tube; and means for stowing away and protecting from recoil shock and contamination;

said sensing system, said means for moving, and said means for stowing being in electrical and mechanical communication and attached to the gun system in close proximity to said gun tube.

2. The sensing device of claim 1 wherein said sensing system includes a transducer system which is operated to swing in and out of place relative to said gun tube.

3. The sensing device of claim 1 wherein said sensing system includes a disk on which electronic controls and laser diodes are embedded to provide detection information of said particulate matter in said gun tube.

4. The sensing device of claim 3 wherein said sensing system includes a receiver to receive signal from said laser diodes and register said one of the presence and absence of particulate matter in said gun tube.

5. The sensing device of claim 1 wherein said sensing system includes a series of diodes circumferentially situated against said gun tube said series of diodes including some which could be pulsed relative to others in said series of diodes.

6. The sensing device of claim 1 wherein said means for moving includes a rotary actuator in electrical communication with said sensing system.

7. The sensing device of claim 1 wherein said means for stowing away includes a stow bracket and a wiper/shock absorber device mounted thereon.

8. An apparatus to automatically sense and check the presence and absence of particulate matter in a gun tube and further to determine the proper positioning of a projectile ram depth in cooperation with a breech block and fire control system, the apparatus comprising;

a sensing system with vision to monitor and detect objects in the gun tube:

means for moving said sensing system in position to engage the gun tube;

means for stowing away and protecting the vision of said sensing system; and means for interfacing data to coordinate operations of said sensing system, the breech block and the fire control to autonomously load and sequentially fire rounds;

said sensing system, said means for moving, said means for stowing and said means for interfacing attached to the gun tube in close proximity to the breech block.

9. An apparatus to autonomously monitor ram depth and sense contents of a gun bore in a system including a breech block and a fire control system to serially and continuously fire projectiles from the gun, the apparatus comprising:

a precision vision system including diode lasers and optics;

means for ambulating said precision vision system;

means for protecting said precision vision system; and electronics control system to provide controls and interface between said precision vision system, said means for ambulating, said means for protecting, said breech block and said fire control system.

10. A method for sensing particles in a gun tube to automate ram depth and gun bore check off for safe firing of projectiles using a sensor device comprising the device implemented steps of:

actuating a transducer from a stow position to a sensing position;

activating a bore clear measurement to be received by a sensor in said transducer;

activating a receiver in said transducer to detect any obstructions within the gun tube bore;

moving said transducer from said sensing position to said stow position; and transmitting status of the sensor to a controller to determine results of said sensing.

11. The method according to claim 10 wherein said step of actuating of said transducer includes moving a breech block away from the breech to thereby allow said transducer to be in said sensing position.

12. The method according to claim 10 wherein said step of activating a receiver includes pulsing laser diodes sequentially until all of said laser diodes project a beam of laser energy down said bore.

13. The method according to claim 10 wherein said step of activating a receiver includes detecting any laser energy reflected from an obstruction within said bore.

14. A method of measuring ram depth of a projectile in a gun bore using a sensor system comprising the sensor system implemented steps of:

actuating a transducer from a stow position to mate with said gun at a sensing position;

sensing the projectile at a rear position as set in a ram position;

activating a receiver in said transducer to measure the projectile depth in said ram position;

moving said transducer from said sensing position to said stow position; and transmitting status of the sensor to a controller to determine results of said measurement.

15. The method according to claim 14 wherein said step of actuating includes moving a breech block out of the way to enable said transducer to engage said gun at said sensing position.

16. The method according to claim 14 wherein said step of sensing includes pulsing energy from at least one of a series of laser diodes with said energy focussed at a proximate end of the projectile.

17. The method according to claim 14 wherein said step of activating a receiver includes detecting energy reflected from the projectile from which data time of flight is calculated and converted into said ram depth of said projectile.

* * * * *